United States Patent [19]

Misset et al.

[11] Patent Number: 4,757,900

[45] Date of Patent: Jul. 19, 1988

[54] PACKING CASE AND METHOD OF PREPARATION

[75] Inventors: René Misset, Fontaine les Dijon; Christophe Graffin, Talant, both of France

[73] Assignee: Laboratoires d'Hygiene et de Dietetique (L.H.D.), Paris, France

[21] Appl. No.: 8,940

[22] Filed: Jan. 30, 1987

[30] Foreign Application Priority Data

Feb. 3, 1986 [FR] France ..... 8601435

[51] Int. Cl.[4] ..... B65D 65/00

[52] U.S. Cl. ..... 206/497; 206/597; 206/521; 53/442; 53/435

[58] Field of Search ..... 206/497, 597, 521, 592; 53/442, 441, 440, 435

[56] References Cited

U.S. PATENT DOCUMENTS

| | | | |
|---|---|---|---|
| 3,669,337 | 6/1972 | Struble | 206/497 |
| 3,987,897 | 10/1976 | Smith | 206/497 |
| 4,087,003 | 5/1979 | Adamek | 206/497 |
| 4,133,430 | 1/1979 | Cravens | 206/497 |
| 4,285,432 | 8/1981 | deVillers et al. | 206/497 |
| 4,306,653 | 12/1981 | Fales | 206/497 |
| 4,328,896 | 5/1982 | Behne | 206/497 |

*Primary Examiner*—Joseph Man-Fu Moy
*Attorney, Agent, or Firm*—Kuhn and Muller

[57] ABSTRACT

The present invention relates to a packing case comprising a box, a heat-retractable plastic and at least one lid, for storing, handling and transporting a charge.

In the said case, the heat-retractable plastic (2, 22) in sheet form is bonded at one or more of its edges (32, 322) to the outer surface of a wall (3) of the said box, in the vicinity of the side of the said wall, and extends, on the outside, from the said edge (32, 322) to the side of the said wall and then inside the box, opposite the inner surface of the said wall, moving away from the latter towards the charge which is to be packed.

In the said case, the charge is held down against the bottom by means of the heat-retractable plastic along an overlapping zone.

10 Claims, 2 Drawing Sheets

PACKING CASE AND METHOD OF PREPARATION

Figure 1:
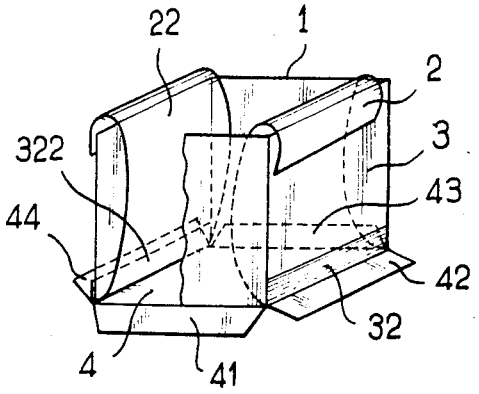

The present invention relates to the packing of a charge consisting of one or more items. More precisely, it relates on the one hand to a packing case in which the charge is held against one or other of the walls or the bottom by means of a heat-retractable plastic, and on the other hand to the packing method using the said case.

Patent Document No. FR- A-2 426 620 has disclosed a packing case in which a charge, housed in a case made in particular of cardboard, is covered with a plastic in sheet form, bonded either to the inside of the bottom or to the inside of two opposite vertical walls. According to Patent Document No. FR- A-2 426 620, a charge is packed using two plastic sheets which overlap at one of their ends, on top of the said charge, and which are heat-sealed in the overlapping zone in order to cover the said charge, the other end of each of these sheets, which is not in contact with the charge, being glued to the inside of the bottom or to the inside of a side wall in the vicinity of the bottom, so that each sheet starts essentially at the bottom and extends away from the said bottom, being substantially vertical thereto.

A packing case of this type has the disadvantage of an insufficient resistance to separation or tearing at the point where these plastic sheets are bonded, inside the case, to the bottom or the side walls. In reality, because the case receives impacts or is dropped or turned over while being handled and transported, the weight of the charge packed so as to be held on the bottom of the case ruptures the above-mentioned bonds between the plastic sheets and the inside of the bottom or the insides of the side walls.

According to the invention, a novel technical solution, differing from that of the prior art, is proposed which overcomes the above-mentioned disadvantage, makes it possible to avoid using a protective liner or padding, especially in the form of a molding or chips made of polyurethane foam, polystyrene foam or a similar foamed material, is economically advantageous on account of using less material, especially cardboard, and makes it possible to produce a completely hermetically sealed packing case.

This novel technical solution is based on the observation that, surprisingly, the resistance to separation or tearing of the heat-retractable material in sheet form, during handling and transportation operations, is improved when the said heat-retractable material is bonded to the case on the outside of the said case, on at least one outer face (bottom or side wall) thereof, the side of the said face, which is covered with the said heat-retractable material in sheet form, acting in opposition to the stresses due to the weight of the charge. In other words, the said side opposes separation or tearing under the action of the weight of the charge when the latter is not in the intended position or configuration.

According to the invention, a packing case made of cardboard or a similar material is recommended for storing, handling and transporting a charge; in the said case, which comprises a box made of cardboard or a similar material and a heat-retractable plastic in sheet form for packing and holding in position a charge which is to be stored and/or transported, and at least one lid closing the said box, the heat-retractable plastic in sheet form is bonded at one or more of its edges to the outer surface of a wall of the said box, in the vicinity of the side of the said wall, and extends, on the outside, from the said edge to the side of the said wall and then inside the box, opposite the inner surface of the said wall, moving away from the latter towards the charge which is to be packed.

The term "bond" is understood here as meaning any durable or essentially permanent fixture produced in particular by glueing (sticking by means of an adhesive) or heat-sealing. Thus, the verb "bond" here encompasses the definitions of the verbs "glue" and "heat-seal".

The case according to the invention includes a heat-retractable plastic consisting of two films which are intended to be heat-sealed in their overlapping zone in order to cover the charge which is to be packed.

These two films are bonded at each of their edges to the same wall of the box or, more advantageously, they are each bonded at the corresponding edge to two opposite walls: one of the films being bonded to a first side wall of the box and the second being bonded to the wall opposite the said first wall.

Figure 2:
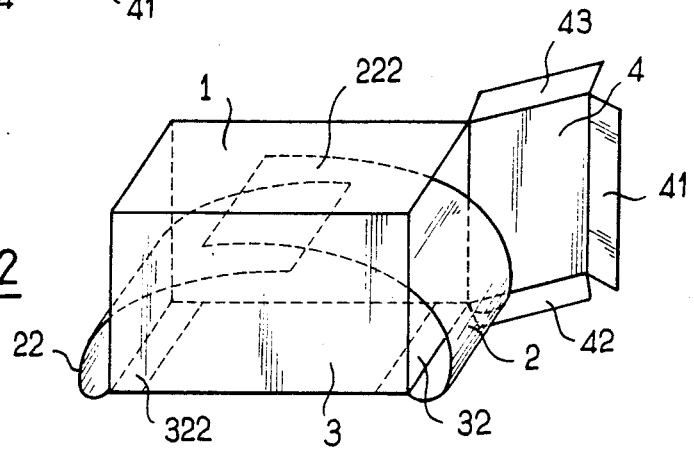
Figure 3:
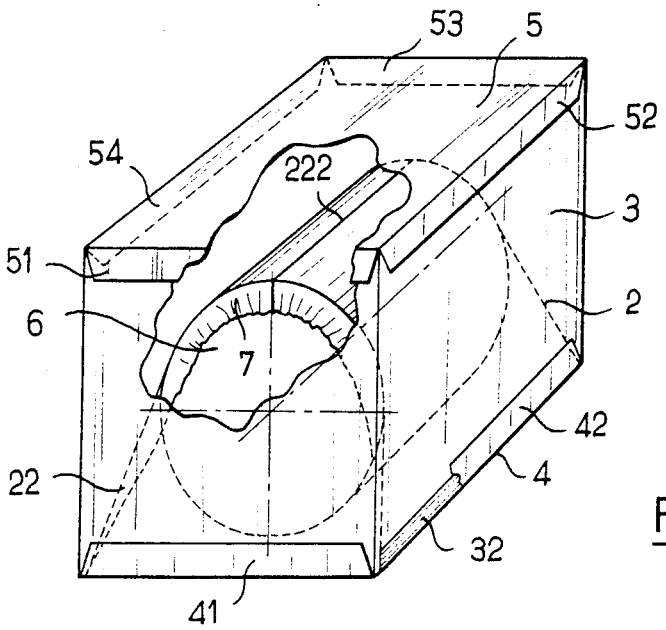
Figure 4:
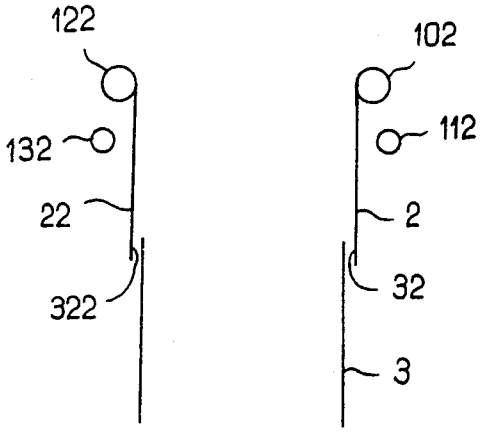
Figure 5:
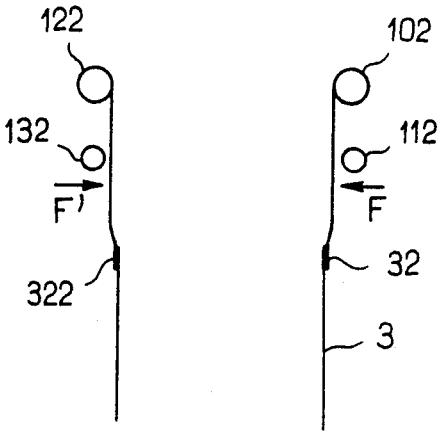
Figure 6:
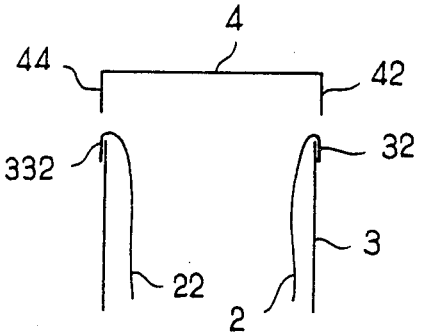

Further advantages and characteristics of the invention will be understood more clearly from the following description of embodiments; these in no way imply a limitation but are given by way of illustration with reference to the attached drawings, in which:

FIG. 1 is a view in perspective of a packing case according to the invention, FIG. 2 is a view in perspective of a packing case according to the invention which differs from that in FIG. 1, FIG. 3 is a view in perspective of a particularly preferred packing case according to the invention, and FIGS. 4 to 6 schematically illustrate the preparation of the case in FIG. 3.

The packing case according to the invention comprises a box 1, which is also termed a ring or tube by those skilled in the art. This box is advantageously in the shape of a parallelepiped and more particularly a right-angled parallelepiped. It is bonded (by glueing or heat-sealing in particular) to the heat-retractable plastic consisting of two films 2 and 22; the film 2 is bonded to the outside of the wall 3 along its edge 32 located in the vicinity of one of the sides of the said wall 3, and the second film 22 is similarly bonded at its edge 322 either to the outside of the wall opposite the wall 3 or to the outside of the same wall 3, in the vicinity of the other side.

Thus, in a first modified embodiment (FIG. 2), the films 2 and 22 are each bonded at their edges 32 and 322 to the same wall 3 of the box. In a second modified embodiment, which is preferred according to the invention, the film 2 is bonded at its edge 32 to a first side wall 3 of the box, and the film 22 is bonded at its edge 322 to the wall opposite the said first wall (FIG. 1).

The plastic films 2 and 22 are advantageously oriented, either biaxially or preferably monoaxially, with a view to the overlapping of their zone 222 for covering the charge 6 by thermal retraction and heat-sealing. These films are generally made of a polyalkylene (especially polyethylene or polypropylene) or any other suitable heat-retractable plastic, its thickness, which is adapted according to the charge, being from 20 to 150 μm in particular.

The bonding edges 32 and 322 are always arranged in the vicinity of at least one opening in the box and in each case on at least one outer face of a side wall 3 of the said box.

A lid 4 closes the box 1, at one or more of whose openings at least one edge 32 and/or 322 bonds the plastic in sheet form to the box. This type of lid, which can have 1, 2, 3 or 4 flaps, is firmly fixed to the said opening by glueing the said flap or flaps to one or more outer faces of the box.

Lids having several flaps are preferred for reasons of convenience and strength. In a modified embodiment, the lid 4 has three flaps carrying the reference numbers 41, 42 and 43 in FIG. 2, the said lid 4 itself forming a first flap if necessary. In a preferred modified embodiment of the invention, the lid 4 has four flaps carrying reference numbers 41, 42, 43 and 44 in FIG. 1.

In the first modified embodiment, the lid 4 closing the box 1, at one of whose openings at least one edge 32 and/or 322 bonds the plastic in sheet form to an outer face of a wall 3, is bonded by its flaps 41 and 43 only to those faces of the said box which have no edge.

In the second, preferred modified embodiment, the lid 4 is bonded by each of its flaps 41, 42, 43 and 44 to those zones of the outer faces of the walls of the box 1 which are located in the vicinity of that opening in the said box at which at least one edge 32 and/or 322 bonds the heat-retractable plastic in sheet form to an outer face 3 of the said box.

Each flap of the lid 4 which comes into contact with one of the edges 32 or 322 is wider than the said edge so as to be bonded (i.e. glued), when overlapping, to the said edge and to that portion of the outer face of the wall 3 of the box 1 which is next to the said edge, as shown in FIG. 3.

It is a very advantageous recommendation for the box 1 to be made using a corrugated or grooved cardboard. In fact, the bonding of the edges 32 and 322 (by glueing or heat-sealing) is stronger when the outside of the wall 3 has a rough surface.

It is more particularly advantageous if the corrugations and/or grooves in the walls of the box are arranged perpendicularly to the sides of the said walls. This configuration is obtained especially by cutting out the box perpendicularly to the said corrugations and/or grooves. The clean edges of the box which are intended to receive the lids offer more resistance to crushing than the flanges known in the prior art.

To obtain the strength of the bonding (by glueing or heat-sealing) between the plastic and the box, it is very important for each of the films 2 and 22 to extend from its bonding edge 32 or 322 towards the corresponding side of the wall 3, to overlap the said side and then to extend inside the box, opposite the said wall, moving away from the latter towards the charge which is to be packed.

If necessary, the packing cases according to the embodiments in FIGS. 1 and 2 have a second lid—not shown in the said figures—which is similar or analogous to the lid 4 and closes the opening opposite that which is closed by the said lid 4. Thus, as shown in FIG. 3, the packing case has a second lid 5 provided with flaps 51, 52, 53 and 54, which is identical to the lid 4.

During the thermal retraction effected, for example, by means of a hot-air gun, for heat-sealing the overlapping zone 222 of the films 2 and 22, the charge 6 can be totally or partially covered with the plastic in sheet form. FIG. 3 shows that partial covering by the means 2, 22 and 222 and the retraction flange 7 is perfectly suitable. The thermoplastic film can be wider than the wall of the box in order to compensate the retraction in width, in particular when a bioriented thermoplastic film is used.

According to the invention, the lid 4 in FIGS. 1 or 3 acts as the bottom of the packing case; in FIG. 2, on the other hand, it is the side wall 3 of the box which serves as the bottom for supporting and holding the charge.

For practical insertion of the charge 6, the following provision, shown in FIG. 1, can be made before it is placed in the case: the free ends of the films 2 and 22 are each folded back, at the opening in the box opposite that which has the bonding edges 32 and 322, over that side of their own wall which is located at the said opposite opening. If necessary, these free ends can be firmly fixed to the outside of each of the corresponding walls 3, especially by means of a temporary adhesive, in order to facilitate the automated or non-automated introduction of the charge into the box between the films 2 and 22.

The invention also relates to a method for packing a charge using a case such as that mentioned above, which method is particularly advantageous for packing in a manner consistent with FIG. 3. In this method:

(a) two heat-retractable plastic films are unrolled downwards from above so that the lower end of each of them faces a zone of the outside of two opposite walls of the box which is located in the vicinity of and under the upper side of each wall;

(b) each of the said lower ends of the films is bonded, especially by heat-sealing, to the said zone which is opposite it, so as to produce the edges 32 and 322 for bonding the heat-retractable plastic to the cardboard box;

(c) each film is cut a certain distance above the said edges so that each resulting plastic film falls into the box, covering the side of the wall which corresponds to its bonding edge;

(d) a lid 4 is glued, by means of its flaps 41, 42, 43 and 44, along the outer periphery of the opening in the box which has, on two opposite walls, the sides covered by the said films, the width of the flaps which are to be glued over the edges being greater than that of the said edges; and (e) the box 1 and the lid 4 bonded in this way are together turned over, the said lid 4 becoming the bottom of the packing case, the charge 6 which is to be packed is placed between the inside of the lid 4 and the films 2 and 22, the said films are then caused to retract in the overlapping zone 222 and, finally, a lid 5, provided in particular with flaps 51, 52, 53 and 54, is fitted on so as to close the second opening in the said box.

FIGS. 4 to 6 schematically illustrate a way of carrying out this method.

The heat-retractable films are unrolled downwards from above by means of the rollers or wheels carrying reference numbers 102 and 122, so that the end of each of these films comes into the immediate vicinity of the zones where the edges 32 and 322 will be bonded, opposite the outer faces of each corresponding wall 3. This positioning can be effected using a guide device which is not shown in its entirety here but is represented diagrammatically by the means 112 and 132.

Each film is then glued or heat-sealed to each wall 3. When this operation is complete, the films 2 and 22 are guided vertically into the box by moving the means 112 and 132 in the directions of the arrows F and F′ respectively.

The films are then cut (for example at a height between the means 10–112 and 122–132) so that the resulting free ends of the films 2 and 22 fall through the opening in the said box into the space inside the said box, and so that each film covers that side of the wall 3 which is located in the vicinity of the corresponding bonding edge 32 or 322.

The lid 4 is glued by means of its flaps, with the flaps 42 and 44 arranged opposite the respective bonding edges 32 and 322, the said edges each being sandwiched between the outside of the corresponding wall 3 and the inside of the corresponding flap 42 or 44.

The assembly obtained in this way is then turned over for the insertion of the charge 6 into the box, the charge being placed on the inside of the lid 4 and covered with the films 2 and 22. The operation involving retraction and sealing of the plastic along the overlapping zone 222 is then performed.

If necessary, the films 2 and 22 can have different lengths. However, especially for continuous packing operations, it is preferred to use films of approximately identical lengths.

What is claimed is:

1. A packing case made of cardboard or a similar material for storing, handling and transporting a charge in said case, which comprises: a box (1) made of cardboard or a similar material; a heat-retractable plastic (2, 22) in sheet form for packing and holding in position a charge (6) which is to be stored and/or transported in said box, and at least one lid (4) closing said box, the heat-retractable plastic (2, 22) in sheet form is bonded at one or more of its edges (32, 322) to an outer surface of a wall (3) of said box, in the vicinity of one or more side ends of said wall, and extends, on the outside, from said edge (32, 322) to the side end of said wall and then inside the box, opposite an inner surface of said wall, extending away from the latter towards the charge which is to be packed.

2. The case as claimed in claim 1, wherein the heat-retractable plastic consists of two films (2, 22) which are heat-sealable in their overlapping zone (222) in order to cover the charge.

3. The case as claimed in claim 2, wherein said two films (2, 22) are each bonded at their edges (32, 322) to the outer surface of the same wall (3) of the box.

4. The case as claimed in claim 2, wherein one of said films (2) is bonded at its edge (32) to a first side wall (3) of a parallelepipedal box (1), and wherein the second of said films (22) is bonded at its edge (322) to a side wall opposite said first wall.

5. The case as claimed in claim 1, wherein the lid (4) closing the box (1) at an opening thereof where at least one edge (32, 322) bonds the heat-retractable plastic in sheet form to said wall (3), is bonded by flaps extending from said lid only to those outer surfaces of said box which have no edge of plastic sheet bonded thereto.

6. The case as claimed in claim 1, wherein the lid (4) having flaps extending therefrom is bonded by each of its flaps to those zones of the outer faces of the walls of the box (1) which are located in the vicinity of an opening in said box at which at least one edge (32, 322) bonds the heat-retractable plastic in sheet form to an outer face (3) of said box.

7. The case as claimed in claim 6, wherein each flap of the lid (4) which comes into contact with one of the bonded edges (32, 322) of said plastic film is wider than said edge so as to be bonded, when overlapping, to said edge of plastic film and to that portion of the outer surface (3) of the box (1) which is next to said edge.

8. The case as claimed in claim 1, wherein the box (1) is made of corrugated cardboard.

9. The case as claimed in claim 1, wherein the heat-retractable plastic consists of two films (2,.22) which are heat-sealable together in their overlapping zone (222) in order to cover the charge, one of these films (2) being bonded at its edge (32) to the outer surface of a first side wall (3) and the other film (22) being bonded at its edge (322) to the outer surface of the wall opposite said first wall, wherein the box (1) has a parallel-elpipedal shape and is made of corrugated cardboard cut beforehand perpendicularly to the direction of the corrugations, and wherein each flap (42, 44) of the closing lid (4) which comes into contact with one of said edges overlaps and is bonded to the edge and to that portion of the outer surface of the wall (3) of the box which is next to said edge.

10. A packing method for a packing case comprising:

(b) unrolling two heat-retractable plastic films downwards from above so that a lower end of each of them faces a zone of an outer surface of two opposite walls of the box which is located in the vicinity of and under an upper side of each wall defining a first open end;

(c) bonding each of said lower ends of the films, especially by heat-sealing, to said zone which is opposite it, so as to produce the bonded edges (32, 322) for the heat-retractable material to the cardboard box;

(d) cutting each film a certain distance above the said edges so that each resulting film falls into the box, covering the side of the wall which corresponds to its bonding edge;

(e) gluing a lid (4), by means of its flaps, along an outer periphery of the first open end in the box which has, on two opposite walls, the sides covered by said films, the width of the flaps which are to be glued over the edges being greater than that of said edges;

(f) turning over the box bonded in this way to said lid (4), the latter becoming the bottom of the packing case, a charge which is to be packed is placed between said, lid (4), forming the bottom, and the films (2, 22) with portions of said films overlapping over a top of said charge;

(g) heating said film wherein the overlapping zone (222) of said films is bonded together and, said film shrinks about said charge; and (h) a lid (5) is fitted on said second open end so as to close that opening in the box which is on the opposite side to the lid (4).

* * * * *

UNITED STATES PATENT AND TRADEMARK OFFICE

CERTIFICATE OF CORRECTION

PATENT NO. : 4,757,900

DATED : July 19, 1988

INVENTOR(S) : Rene Misset and Christophe Graffin

It is certified that error appears in the above—identified patent and that said Letters Patent is hereby corrected as shown below:

Column 6, line 27, insert:

(a) providing a box having side walls and two opposite open ends;

Signed and Sealed this

Twenty-seventh Day of December, 1988

*Attest:*

DONALD J. QUIGG

*Attesting Officer*

*Commissioner of Patents and Trademarks*